United States Patent [19]

Watson

[11] Patent Number: 4,638,941

[45] Date of Patent: Jan. 27, 1987

[54] SHIPPING AND DISPLAY CONTAINER

[75] Inventor: Robert L. Watson, Mt. Vernon, Ohio

[73] Assignee: Weyerhaeuser Company, Tacoma, Wash.

[21] Appl. No.: 770,825

[22] Filed: Aug. 28, 1985

[51] Int. Cl.[4] ..... B65D 5/22

[52] U.S. Cl. ..... 229/104; 229/190; 229/DIG. 11; 206/511; 206/821

[58] Field of Search ..... 229/30, 32, 34 A, 34 B, 229/DIG. 11, 104, 190; 206/511, 512, 821, 430

[56] References Cited

U.S. PATENT DOCUMENTS

| | | | |
|---|---|---|---|
| 743,205 | 11/1903 | Tupper et al. | 229/32 |
| 1,142,017 | 6/1915 | Brown | 229/30 |
| 1,513,608 | 10/1924 | Cabombarde | 229/32 |
| 2,292,540 | 8/1942 | Norton | 229/34 A |
| 2,328,689 | 9/1943 | Shofer | 229/32 |
| 2,620,117 | 12/1952 | Nemoede | 229/34 A |
| 3,825,169 | 7/1974 | Meyers | 229/34 |
| 3,944,129 | 3/1976 | McCall et al. | 229/32 |
| 4,244,472 | 1/1981 | Brown | 206/597 |
| 4,418,863 | 12/1983 | Kimbrell, Sr. | 229/49 |

*Primary Examiner*—William Price
*Assistant Examiner*—Gary E. Elkins

[57] ABSTRACT

Paperboard containers for shipping and display have been invented that utilize the various parts of the container. Columns of containers possess excellent stacking strength and stability because rigid relationships exist between the containers. The rigid relationships are derived from good connections between the parts of the containers and the contents within. Since only a part of the contents are needed to develop column strength and stability, the contents are displayed.

3 Claims, 6 Drawing Figures

Fig. 2
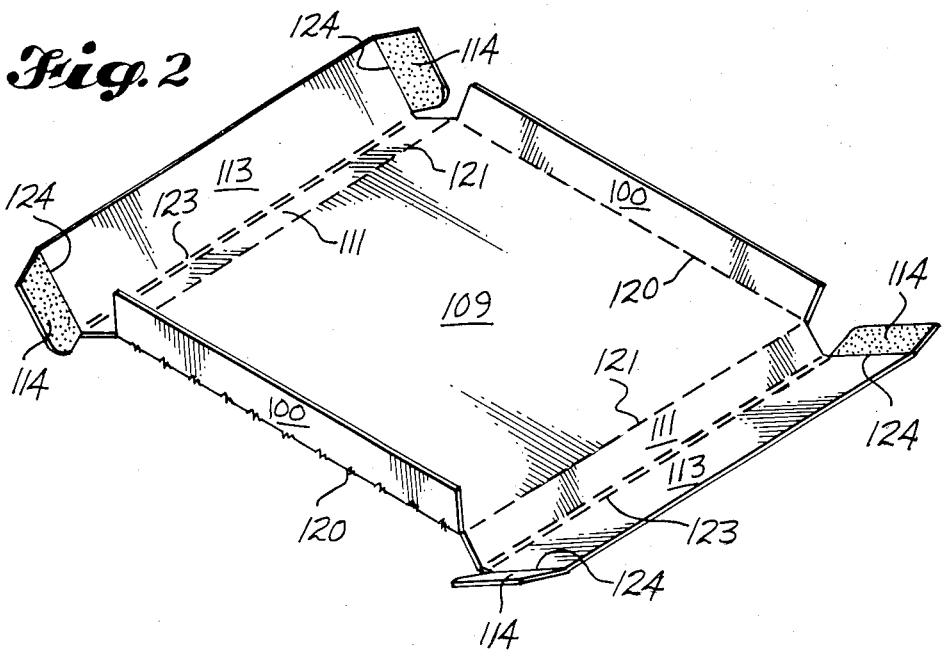
Fig. 3
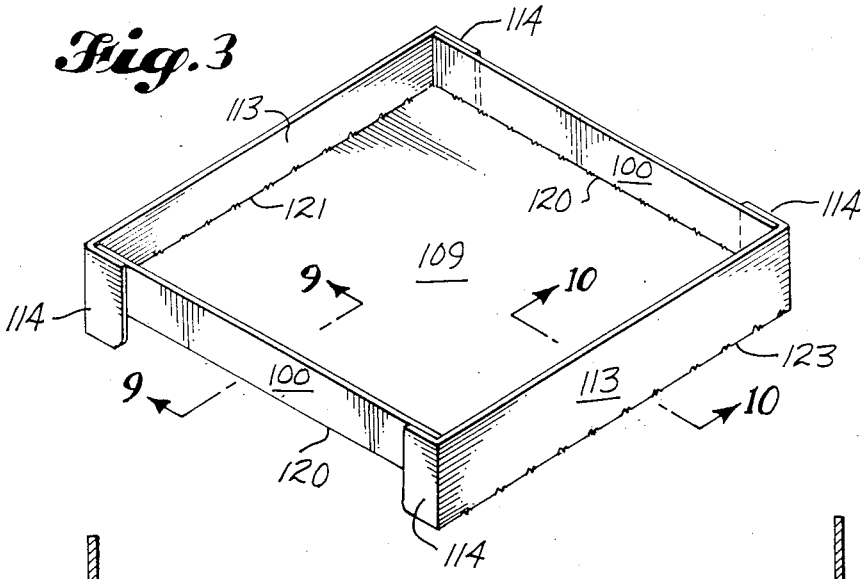
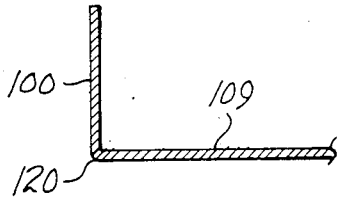
Fig. 4
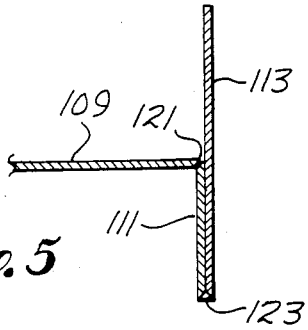
Fig. 5

SHIPPING AND DISPLAY CONTAINER

BACKGROUND OF THE INVENTION

This invention relates to paperboard containers used for shipping and displaying goods and other materials. The container is designed to provide strength and rigidity to a column of stacked containers while displaying the contents. Stacking strength and rigidity of prior paperboard containers has been achieved by various configurations of the corners and interlocking tabs of containers. While the container shown in U.S. Pat. No. 3,825,169 provides the panels joined to and totally raised above a base, the instant invention provides panels below a base. Also, while the container shown in U.S. Pat. No. 4,244,472 provides panels below a base by cutting out a portion of the base material, the instant invention provides panels below the base without using base material.

SUMMARY OF THE INVENTION

This invention provides strength and stability to stacked containers through novel configuration and use of the base, corners and walls of containers. The container has no top. The corners and walls extend above and below the container base. The corners and walls below the container base form a tight, rigid relationship with the contents of a container disposed thereunder. The corners and walls above the base of a container disposed thereunder also form a tight, rigid relationship with the same contents. Moreover, a rigid relationship exists between the base of the container and the contents of a container disposed thereunder. In this way, the contents are partially surrounded and restrained, the containers are rigidly connected and stability and strength is provided to a column of containers.

Display of the contents is also provided by this invention. The contents of the containers are displayed between containers and on top a container disposed thereabove a column of containers. A plastic wrap or an empty container contains the contents of a container disposed thereabove when a column of containers is shipped. The exposure of the object can be increased by reducing the amount of wall material.

DESCRIPTION OF DRAWINGS

FIG. 2 is an isometric view of a partially folded blank of FIG. 1.

FIG. 3 is an isometric view of a modified shipping and display container.

FIG. 4 is a cross section through lines 9—9 of FIG. 3.

FIG. 5 is a cross section through lines 10—10 of FIG. 3.

DESCRIPTION OF THE PREFERRED EMBODIMENT

Modified shipping and display container

Figure 6:
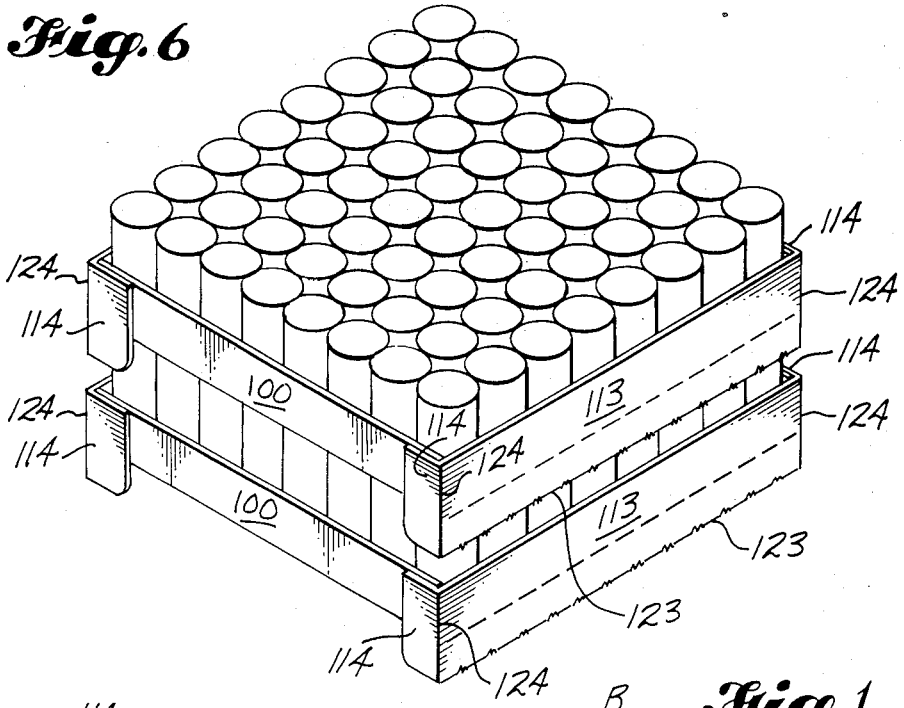
FIG. 6 is an isometric view of two stacked modified shipping and display containers.
Figure 1:
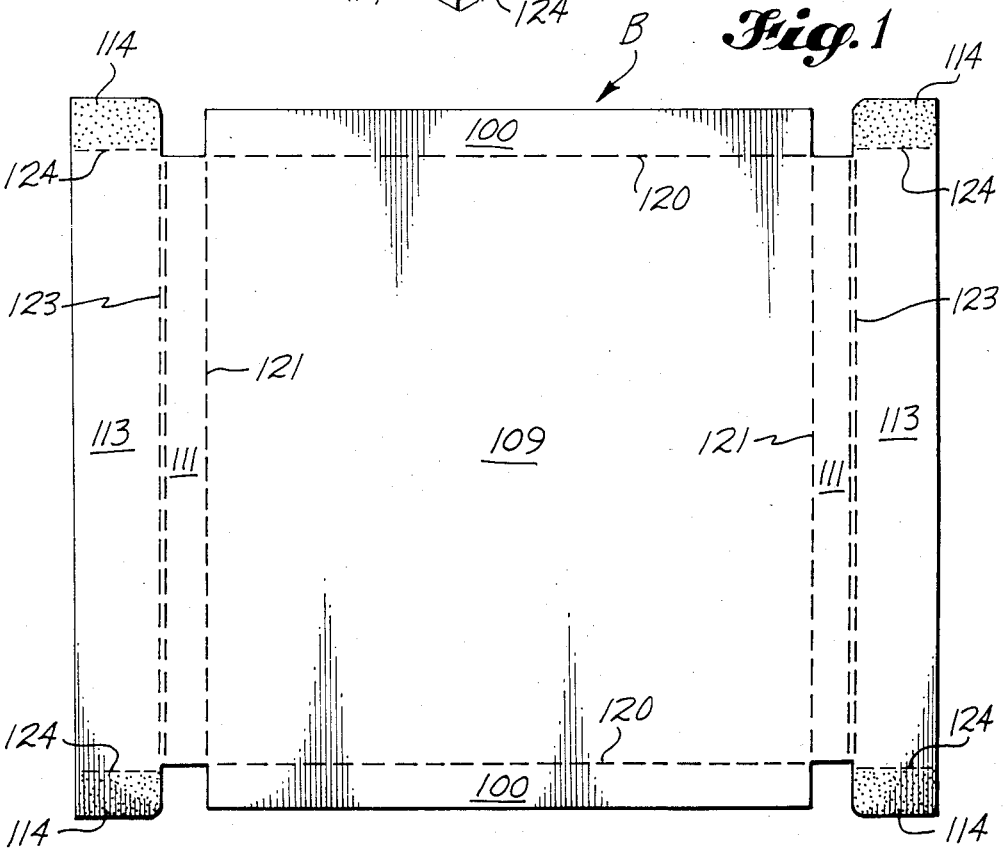
FIG. 1 is a top plan view of a shipping and display container blank which is cut and scored.

The shipping and display container is modified to provide greater exposure of contents of the container. As shown in FIG. 6 a blank B of unfolded paperboard is cut and scored for folding to form container of FIG. 3. The blank B comprises a base 109 having end walls 100 and side walls 111 hingedly attached to the base 109 along fold lines 120 and 121, respectively. Side panels 113 are hingedly attached to said side walls 111 along single- or double-fold lines 123. Four flaps 114 are hingedly attached to side panels 113 along fold lines 124.

The construction of the modified container is initiated by folding the blank B along fold lines in the manner described herein. The end walls 100 are folded above the base 109 to lie perpendicular with base 109 as shown in FIGS. 2 and 4 to provide greater exposure of contents disposed thereunder. The side walls 111 are folded below the base 109 and the side panels 113 are folded above the base 109 as shown in FIG. 2. The side walls 111 and side panels 113 are folded until the side walls and side panels are in a position perpendicular to the base 109 as indicated by FIG. 5 to form the basic structure of the modified shipping and display container. Flaps 114 are turned to lie adjacent to the outside surface of end walls 100 as shown in FIG. 3. Flaps 114 are provided a means for fastening to the outside surface of the end walls 100 to complete construction of the container shown in FIG. 3.

The shipping and display container is further illustrated in FIG. 6. Two containers D1 and D2 are shown. The dashed lines illustrate the position of the base 109 for each container. Container D2 rests on the contents of container D1. FIG. 6 shows that the lack of end panels in the shipping and display container provides display.

I claim:

1. A shipping and display container comprising;

a base with four linear edges, a first pair of opposing walls extending from opposing edges of said base to lie below and perpendicular to said base, each of said first pair of opposing walls having a lower edge parallel to said edge of said base, a second pair of opposing walls extending from remaining opposing edges of said base to lie above and perpendicular to said base, each of said second pair of opposing walls having an upper edge parallel to said edge of said base, each of said walls extending the entire length of said associated edge of said base, a panel extending from the entire length of said lower edge of each of said first pair of opposing walls and extending above said base, said panel having an upper edge parallel to said lower edge of said first pair of opposing walls, means for joining said panels to said second pair of opposing walls, said means comprising a substantially rectangular flap extending from each of the vertical edges of said panels, said flaps being contiguous with an adjacent wall wherein said flaps are joined to said adjacent walls, said flaps extending below said base, whereby said base may act as a base for contents contained therein, and as a cover for contents contained in a second similar container disposed thereunder and said panels and said second pair of opposing walls may surround said contents contained therein and said first pair of opposing walls and said flaps may surround said similar contents contained thereunder.

2. A shipping and display container as claimed in claim 1 wherein the distance between said base and said upper edge of each of said panels equals the distance between said base and said upper edge of each of said second pair of opposing walls.

3. A container as claimed in claim 1 where said walls and said panels surround a plurality of contents filling said container wherein additional said containers rest on said contents filling said container for additional stacking wherein said panel height is less than the height of said contents for display.

* * * * *